US010940993B1

(12) United States Patent
Serkasevich et al.

(10) Patent No.: US 10,940,993 B1
(45) Date of Patent: Mar. 9, 2021

(54) SINGLE-SERVE CONDIMENT CONTAINER AND DISPENSER

(71) Applicants: Gina Serkasevich, Huffman, TX (US); Caden Serkasevich Calkins, Huffman, TX (US)

(72) Inventors: Gina Serkasevich, Huffman, TX (US); Caden Serkasevich Calkins, Huffman, TX (US)

( * ) Notice: Subject to any disclaimer, the term of this patent is extended or adjusted under 35 U.S.C. 154(b) by 0 days.

(21) Appl. No.: 16/419,427

(22) Filed: May 22, 2019

(51) Int. Cl.

| | |
|---|---|
| ***B65D 85/72*** | (2006.01) |
| ***B65D 83/00*** | (2006.01) |
| ***B05C 17/10*** | (2006.01) |
| ***B05C 17/005*** | (2006.01) |

(52) U.S. Cl.
CPC ..... *B65D 85/72* (2013.01); *B05C 17/00516* (2013.01); *B05C 17/10* (2013.01); *B65D 83/0005* (2013.01); *B65D 83/0072* (2013.01)

(58) Field of Classification Search
CPC ..... B65D 83/0005; B65D 83/0072; B65D 85/72; B65D 35/38; B05C 17/00516; B05C 17/10; B67B 7/28
See application file for complete search history.

(56) References Cited

U.S. PATENT DOCUMENTS 2,135,378 A * 11/1938 Murray ..... B67B 7/28 222/83.5
2,197,579 A * 4/1940 Hooper ..... B65D 35/38 401/262
2,434,505 A * 1/1948 Miller ..... B65D 35/10 222/105
4,648,506 A 3/1987 Campbell et al.
5,000,361 A * 3/1991 Briddell ..... B05C 17/00516 222/575
5,111,932 A 5/1992 Campbell et al.
5,725,722 A * 3/1998 Eshleman ..... A47G 27/0443 156/502
6,450,723 B1 * 9/2002 Lithgow ..... B05C 17/00516 222/566
6,935,783 B2 8/2005 Carter
8,393,815 B2 3/2013 Crucs
8,403,581 B2 3/2013 Crucs
8,607,459 B2 12/2013 Geissler
(Continued)

FOREIGN PATENT DOCUMENTS

GB 512681 * 9/1939 ..... B65D 35/38
JP 08052403 * 2/1996 ..... B05C 17/00516

*Primary Examiner* — J C Jacyna
(74) *Attorney, Agent, or Firm* — Cramer Patent & Design, PLLC; Aaron R. Cramer

(57) ABSTRACT

A condiment container that includes a hollow lower sidewall having a bottom with an inwardly projecting shelf. The lower sidewall defines a lower cavity and a false bottom is captured within the lower sidewall. An upper portion extends from the lower sidewall to define an upper cavity. That upper portion includes an upper front wall with a first height, a higher upper rear wall, a first side neck wall, a second side neck wall, and a top wall. A condiment pack and a toothed track are located within the lower cavity. Moving the false bottom toward the top wall causes the toothed track to rupture the condiment pack. The top wall has a slot for condiment in the ruptured pack to leave the container. At least one serrated edge is disposed along the slot to enable spreading the released condiment.

9 Claims, 8 Drawing Sheets

(56) References Cited

U.S. PATENT DOCUMENTS

| | | | | |
|---|---|---|---|---|
| 8,962,061 | B1 | 2/2015 | Gray | |
| 9,061,796 | B2 | 6/2015 | Caldwell et al. | |
| 9,681,680 | B1 | 6/2017 | Gray | |
| 2002/0190084 | A1* | 12/2002 | Ichikawa | B05C 17/01 222/327 |
| 2003/0209575 | A1* | 11/2003 | Bremner | B65D 35/38 222/566 |
| 2005/0085786 | A1* | 4/2005 | Baessler | B65D 83/0072 604/408 |
| 2006/0175348 | A1* | 8/2006 | Wood | B65D 77/18 222/94 |
| 2007/0114248 | A1* | 5/2007 | Kovac | B65D 83/0072 222/327 |
| 2008/0023495 | A1* | 1/2008 | Takayama | B05C 17/00516 222/391 |
| 2008/0029552 | A1* | 2/2008 | Apfel | B65D 83/0005 222/386 |
| 2008/0205971 | A1 | 8/2008 | Liberatore et al. | |
| 2015/0129610 | A1* | 5/2015 | Ciecorka | B65D 75/5883 222/92 |
| 2018/0362244 | A1* | 12/2018 | Urbanczyk | A47G 19/26 |

* cited by examiner

SINGLE-SERVE CONDIMENT CONTAINER AND DISPENSER

FIELD OF THE INVENTION

The present invention relates to condiment dispensers. More specifically, it relates to single-serving condiment containers and dispensers.

BACKGROUND OF THE INVENTION

Spreadable condiments such as butter, cream cheese, jelly, syrups, peanut butter, ketchup, mustard, and the like are common items at most restaurants. For those restaurants that serve meals on-the-go such condiments are usually made available in almost ubiquitous single-serve dispensers. Such single-serve dispensers have proven themselves to be highly useful.

Single-serve dispensers usually suffer from at least 3 major drawbacks. The first is that when tables are not available a user often has to balance the self-serve dispenser and his entrée that is to receive the condiment. Such conditions often occur in motor vehicles, while walking, or while trying to attend to other tasks such as caring for a child, talking on the phone, or reading a paper. The result more often than not is that the condiment is not adequately spread or even worse, the food item ends up dropped and wasted.

Another major problem with single-serve dispensers is that they require something such as a plastic knife to properly spread the condiment. Thus, another implement has to be handled as a user attempts to spread the condiment on his entrée. Furthermore, the prior art act of squeezing the condiment dispenser to force the condiment from the dispenser typically requires 2 hands, as well as a virtual third hand to hold the entrée that receives the condiment.

In view of the foregoing there exists a need for a single-serve condiment dispenser that does not require another utensil to spread the condiment on an entrée. Preferably such a single-serve condiment dispenser could be used with only one hand. Ideally, such a single-serve condiment dispenser could be used with one hand while the other hand holds the entrée. Beneficially such a single-serve condiment dispenser would be easy to use and would be suitable for being made available at low cost. Even better would be such a single-serve condiment dispenser suitable for dispensing a wide range of condiments having different viscosities.

SUMMARY OF THE INVENTION

The principles of the present invention provide for single-serve condiment dispensers that do not require another utensil to spread the condiment on an entrée. In addition, such single-serve condiment dispensers can be used with only one hand. One-handed dispensing enables the user to use his other hand to hold the entrée as the contained condiment is dispensed and spread. Such single-serve condiment dispensers are easy to use and are suitable for being made available at low cost. In addition, such single-serve condiment dispensers are suitable for dispensing a wide range of condiments having different viscosities.

A condiment dispenser that is in accord with the present invention includes a hollow cylindrical lower sidewall having a bottom with an inwardly projecting shelf. The lower sidewall defines a lower cavity. A false bottom is captured within the lower sidewall by the shelf. Also included is an upper portion that extends from the lower sidewall to define an upper cavity. That upper portion includes an upper front wall with a first height, a higher upper rear wall, a first side neck wall, a second side neck wall, and a top wall. The top wall extends upward from the upper front wall to the upper rear wall. Also included is a condiment pack within the lower cavity. Moving the false bottom toward the top wall causes the condiment pack to rupture.

In practice the lower cavity is dimensioned to receive an inserted finger. Preferably, the false bottom is circular and is beneficially fixed inside the condiment dispenser. The first side neck wall may have a curved surface. Also included is a slot that passes through the top wall to provide fluid communication between the interior of the condiment dispenser and its exterior. Further included is a toothed track inside the condiment dispenser and above the condiment pack. If that exists, the toothed track may include a downwardly pointed barb. In practice, the condiment pack will contain a condiment that is released when the false bottom pushes the condiment pack into contact with the toothed track. Also, one or more serrated edge can be disposed along the slot.

Another condiment dispenser that is in accord with the present invention includes a hollow cylindrical lower sidewall having a bottom with an inwardly projecting shelf. That lower sidewall defines a lower cavity. Also included is a false bottom which is captured within the lower sidewall by the shelf Δn upper cavity is defined by a front wall that extends upward from the lower sidewall, a higher rear wall that extends upward from the lower sidewall, a curved first side wall that extends upward from the lower sidewall, a curved second wall that extends upward from the lower sidewall, and a top wall across the tops of the front wall, the rear wall, the first side wall, and the second side wall. The top wall extends upward from the front wall to the rear wall. Also included is a condiment pack within the lower cavity. By moving the false bottom toward the top wall, the condiment pack ruptured.

That alternative embodiment condiment dispenser may have a lower cavity dimensioned to receive an inserted finger that pushes the false bottom upward. In practice the false bottom is circular. Beneficially there is a slot through the top wall that provides fluid communication between the interior of the condiment dispenser and its exterior. Also, beneficially there is a toothed track inside the condiment dispenser and above the condiment pack. That toothed track can include a downwardly pointed barb. In practice, the condiment pack contains a condiment that is released when the false bottom pushes the condiment pack into contact with the toothed track. Also included might be one or more serrated edge disposed along the sides of the slot.

BRIEF DESCRIPTION OF THE DRAWINGS

The advantages and features of the present invention will become better understood with reference to the following detailed description and claims when taken in conjunction with the accompanying drawings, in which like elements are identified with like symbols, and in which:

DESCRIPTIVE KEY

Figure 1:
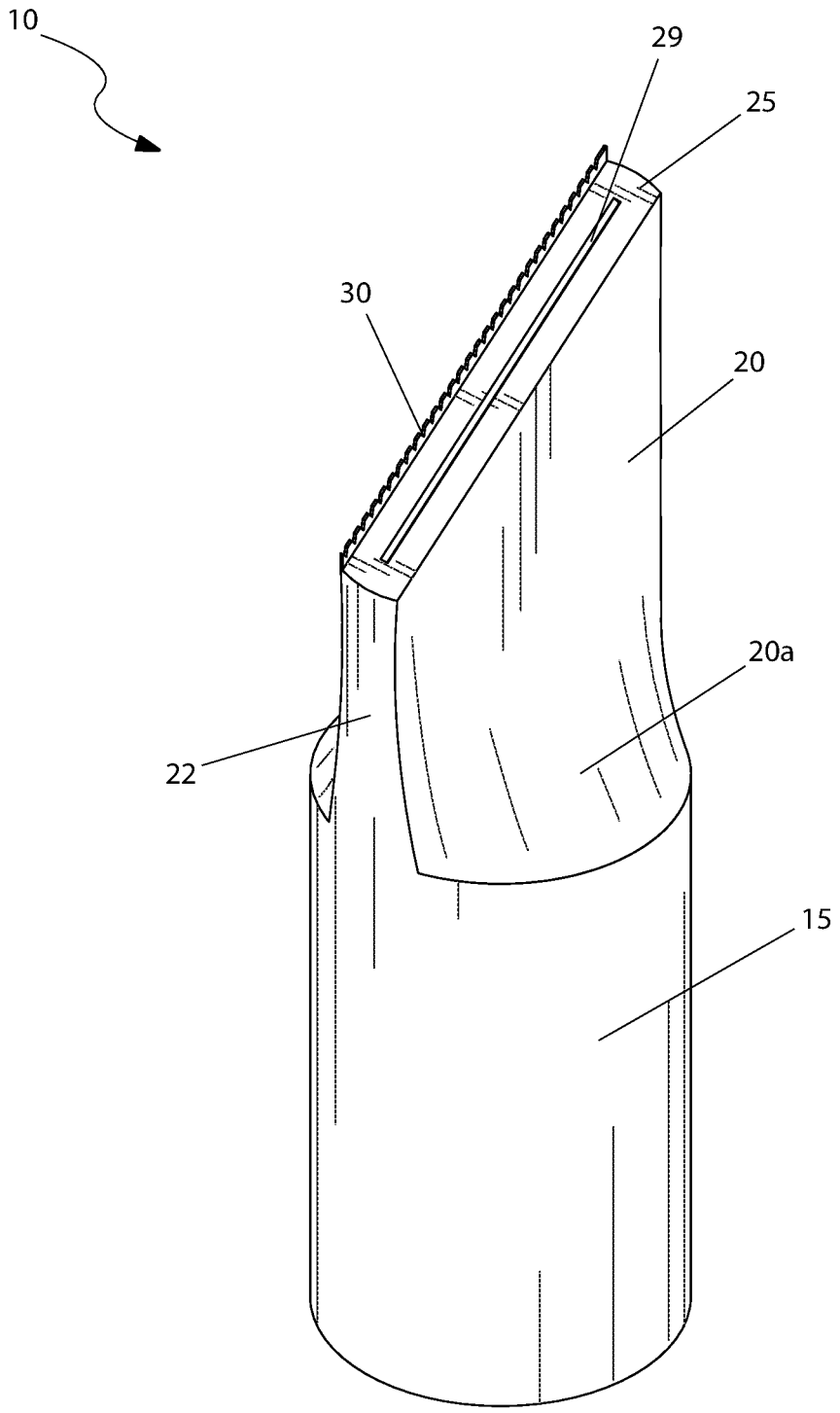
FIG. 1 is a first side perspective view of a condiment container and dispenser 10 which is in accord with the principles of the present invention.

10 condiment container and dispenser
12 false bottom
14 shelf
15 lower sidewall
20 first side neck wall
20*a* first side surface
21 second side neck wall
21*a* second side surface
22 upper front wall
25 top wall
26 upper rear wall
29 slot
30 serrated edge
31*a* inner cavity first region
31*b* inner cavity second region
31*c* inner cavity third region
35 toothed track
40 condiment pack
45 condiment
47 condiment flow
50 user

DETAILED DESCRIPTION OF THE INVENTION

Preferred embodiments of the present invention are depicted in FIGS. 1 through 7*b*. However, the invention is not limited to the specifically described embodiments. A person skilled in the art will appreciate that many other embodiments of the invention are possible without deviating from the basic concept of the invention. Any such work around will also fall under the scope of this invention.

The terms "a" and "an" as used herein do not denote a limitation of quantity, but rather denote the presence of at least one of the referenced items.

Figure 7A:
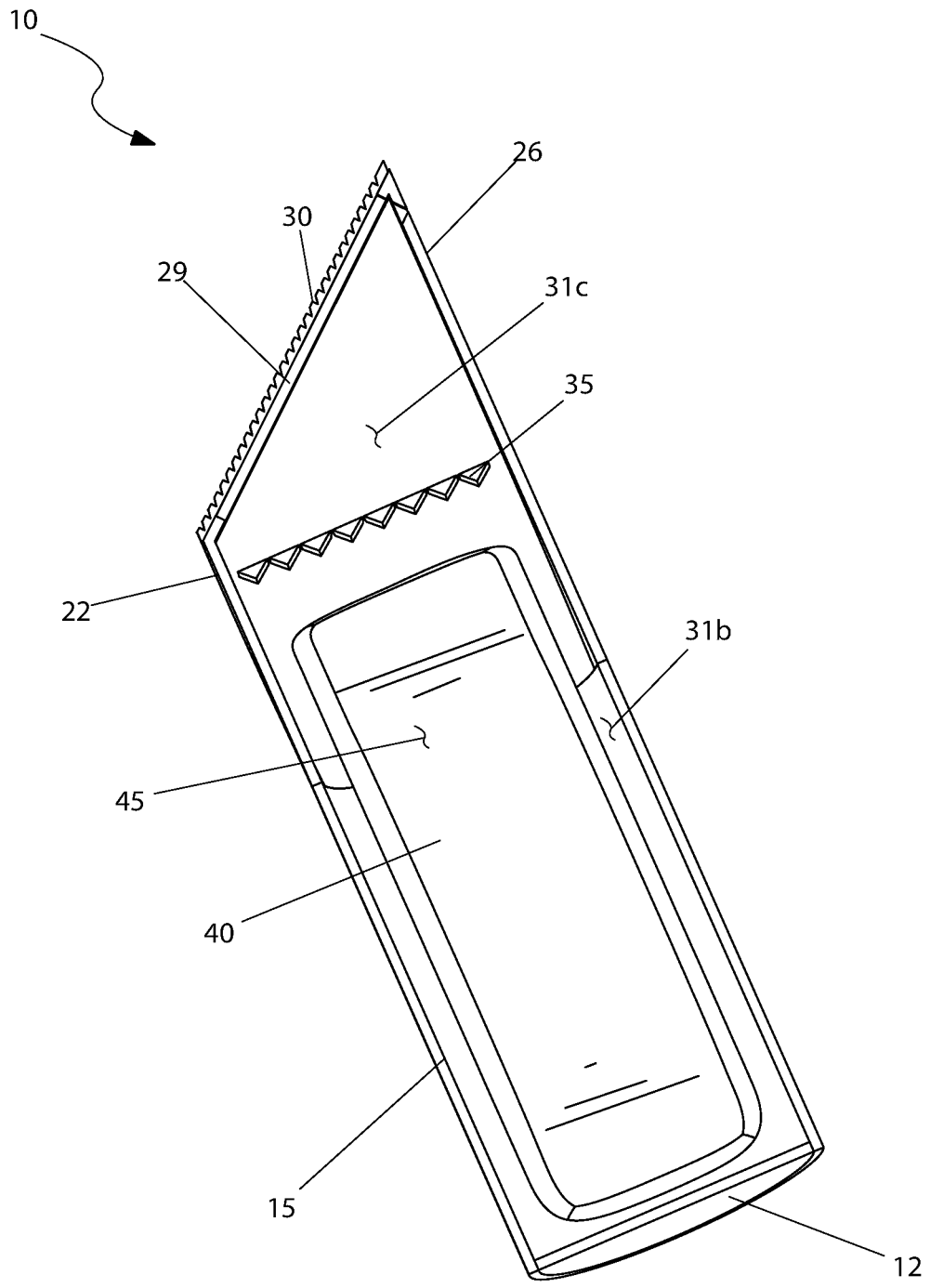
FIG. 7*a* is a sectional view of the condiment container and dispenser 10 taken along line II-II of FIG. 3; and, FIG. 7*b* is a sectional view of the condiment container and dispenser 10 shown in FIG. 3 in use.
Figure 7B:
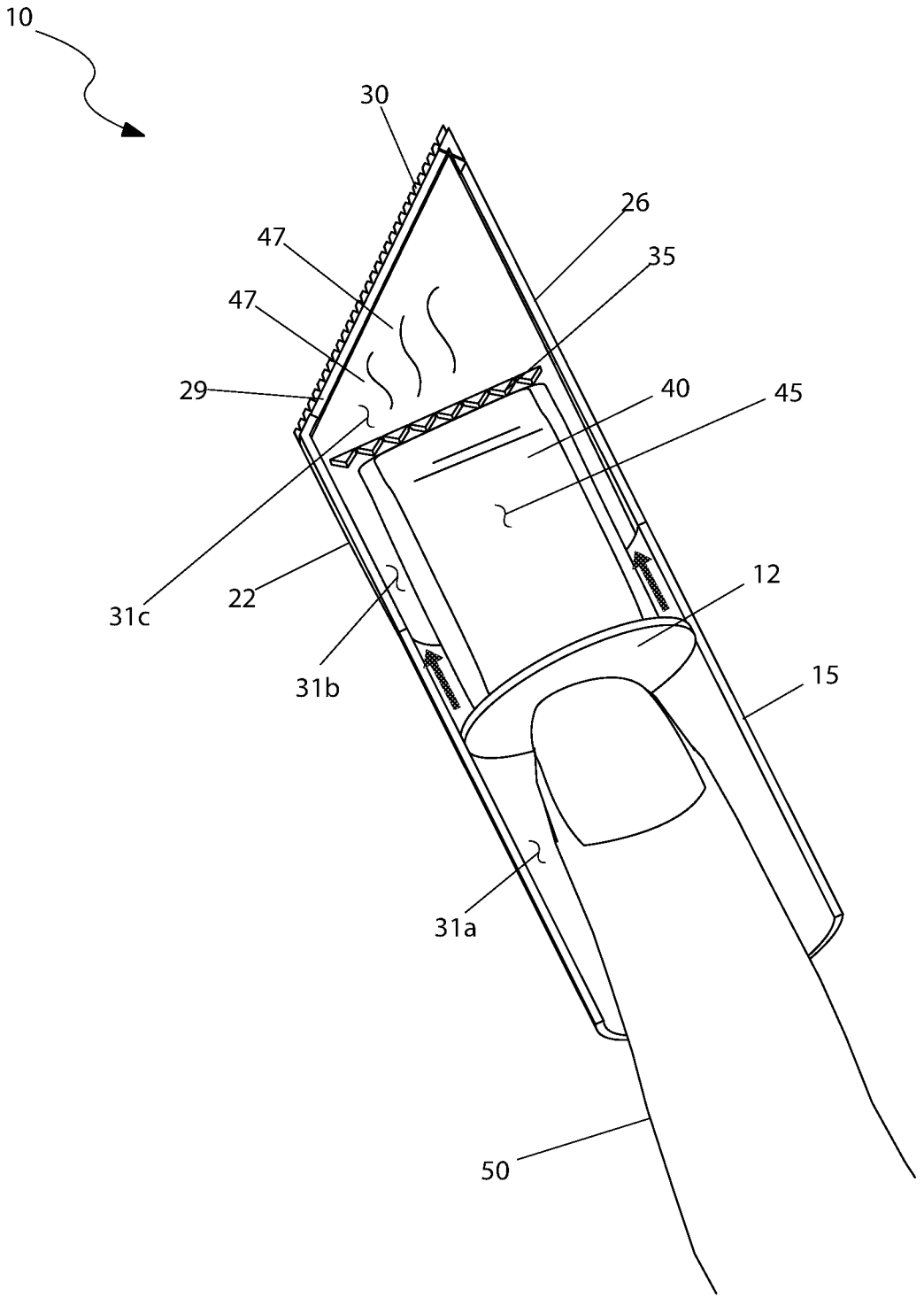

With particular reference to FIGS. 7*a* and 7*b*, the present invention relates to a condiment container and dispenser 10 for holding and dispensing a condiment 45 such as catsup, mustard, mayonnaise, relish, hot sauce, and the like. The condiment container and dispenser 10 is well suited for retaining its condiment 45 until it is desired to be dispensed and to then dispense that condiment 45 using one hand. The condiment container and dispenser 10 enables a user 50 to selectively rupture a condiment pack 40 that retains the condiment 45 and to then release, dispense, and spread that condiment 45 as desired, again using only one hand. After use the condiment container and dispenser 10 can be conveniently disposed of.

Refer now to FIGS. 1 through 5 for various external views of two embodiments of the condiment container and dispenser 10. The embodiments of the condiment container and dispenser 10 are preferably manufactured of materials that is easily fabricated and which are capable of being safely disposed of Such materials can include a resilient plastic or a natural material that is relatively inert and easily molded and is preferably biodegradable. Particularly useful materials include plant-based synthetic biopolymers such as Ingeo™ or Greenstripe®.

Figure 6:
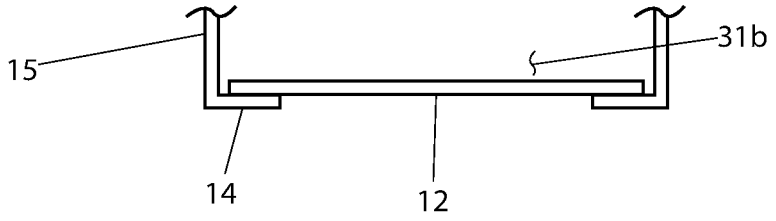
FIG. 6 is a sectional view of the condiment container and dispenser 10 taken along line I-I of FIG. 3.

In any event the condiment container and dispenser 10 embodiments are hollow structures having cylindrical lower sidewalls 15. Referring temporarily to FIG. 6, the bottom of the lower sidewall 15 ends in an inward projecting shelf 14. The shelf 14 retains a disk-shaped false bottom 12 such that it can only travel upward within the lower sidewall 15. Beneficially the false bottom 12 cannot be removed from a cavity 31*b* in the lower sidewall 15.

Figure 2:
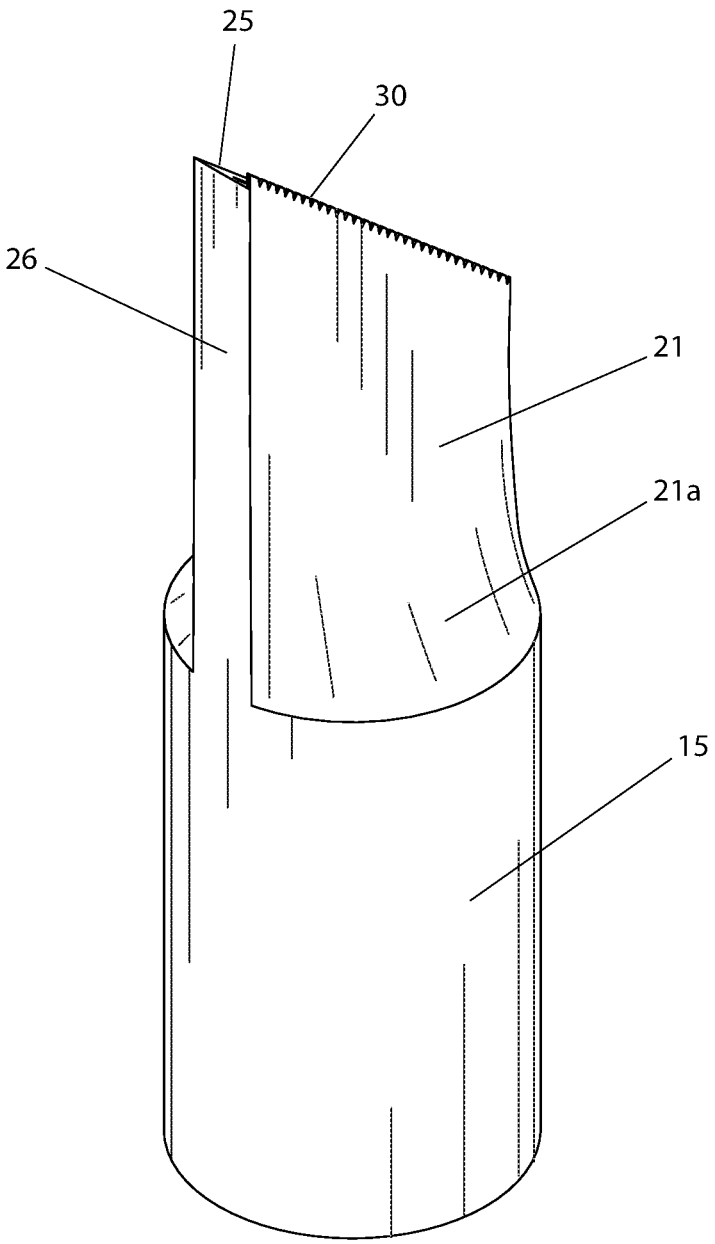
FIG. 2 is a second side perspective view of the condiment container and dispenser 10 shown in FIG. 1.

Returning to FIGS. 1-5, extending from the lower sidewall 15 is an upper portion comprised of an upper front wall 22 having a first height, a somewhat higher upper rear wall 26, a first side neck wall 20, a second side neck wall 21, and a top wall 25. As best seen in FIG. 1 the upper front wall 21 extends from the lower sidewall 15, and as best seen in FIG. 2 the upper rear wall 26 extends from the opposite side of the lower sidewall 15. FIGS. 1 through 4 show the top wall 25 extending between the tops of the upper front wall 22 and rear wall 26. Since the upper rear wall 26 is somewhat higher than the upper front wall 22 the top wall 25 extends at an angle relative to those walls.

Figure 3:
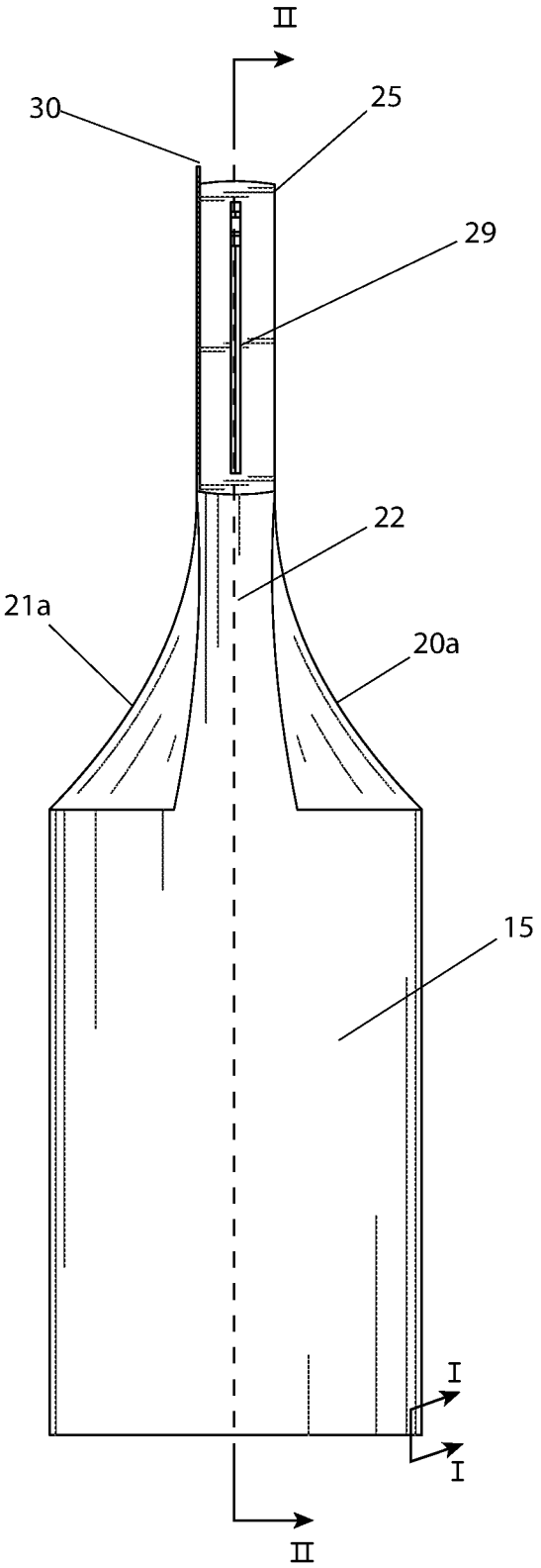
FIG. 3 is a front elevation view of the condiment container and dispenser 10 shown in FIGS. 1 and 2.
Figure 4:
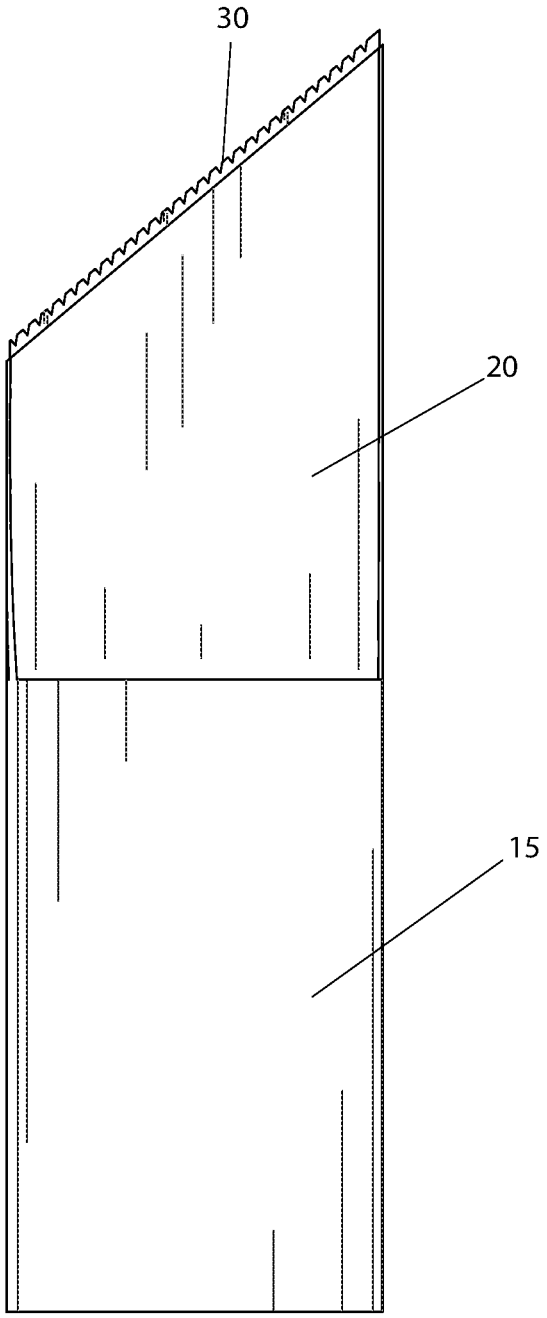
FIG. 4 is a first side elevation view of the condiment container and dispenser 10 shown in FIGS. 1-3.

As best shown in FIGS. 1 and 3, the first side neck wall 20 has a curved surface 20*a*, and as best shown in FIGS. 2 and 3, the second sidewall 21 has a curved surface 21*a*. As shown in those Figures the tops of the first side wall 20 and second sidewall 21 extend as required to mate with the angled top wall 25.

Figure 5:
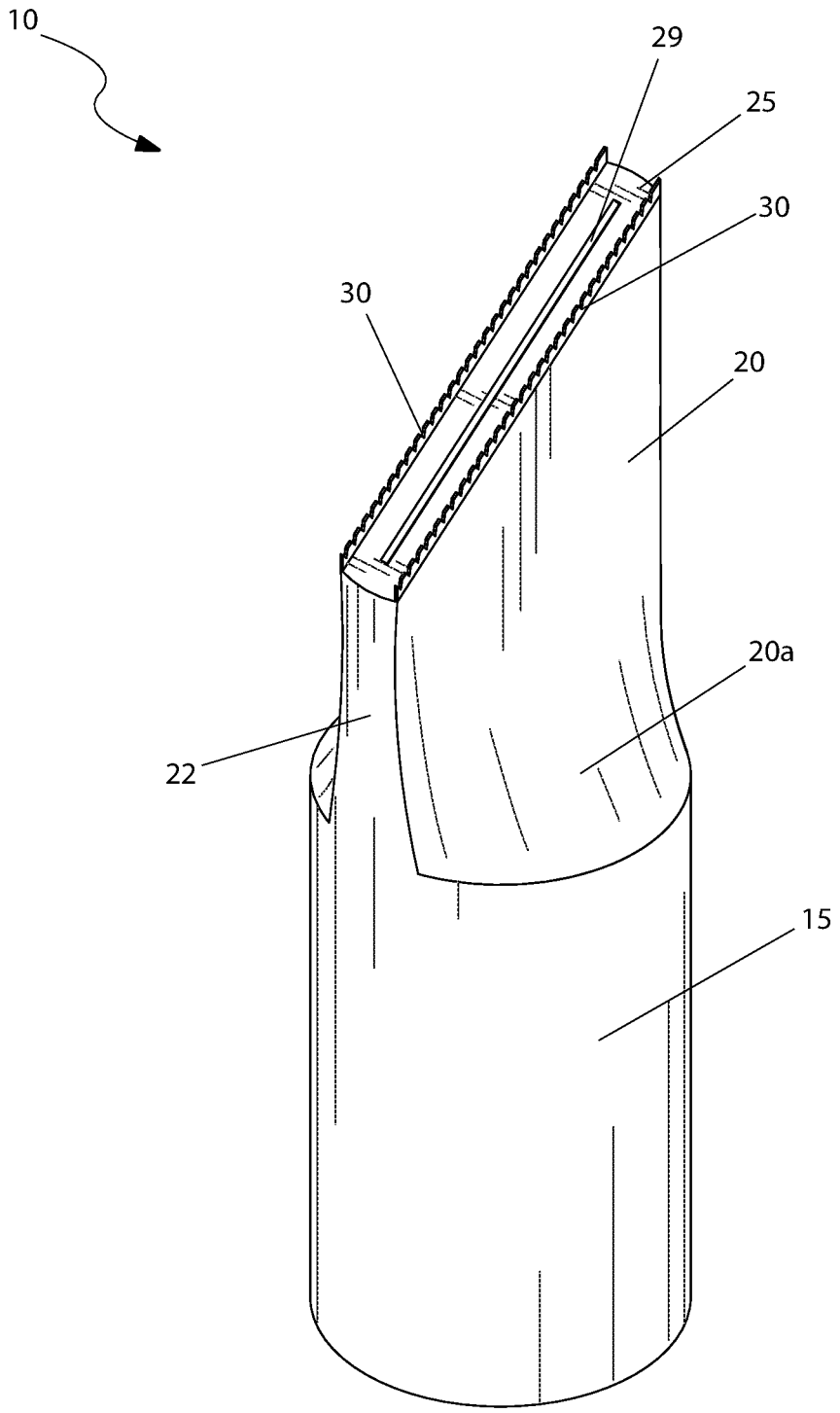
FIG. 5 is a first side perspective view of an alternate embodiment condiment container and dispenser 10.

As shown in FIGS. 1 through 4 attached to or formed along the top wall 25 is an extending serrated edge 30. The serrated edge 30 is preferably of the same material and is formed at the same time as the top wall 25. FIG. 5 presents an alternative embodiment of the condiment container and dispenser 10 which has two (2) serrated edges 30. FIGS. 7*a* and 7*b* are generic illustrations that fit both embodiments.

The lengths of the serrated edge(s) 30 are preferably coextensive with the length of the top wall 25, or at least with the majority thereof. Centrally located on the top wall 25 of both embodiments is a slot 29 that provides fluid communication between the interior of the condiment container and dispenser 10 and its exterior. The slot 29 is preferably long and rather narrow (e.g., about one-fourth (¼) of the width of the upper portion top wall 25) and has ends that terminate prior to the transition of the top wall 25 into the upper front wall 22 and upper rear wall 26. However, for condiments with high viscosities the width of the slot 29 should be increased.

Referring now primarily to the interior views of FIGS. 7*a* and 7*b*, attached inside the condiment container and dispenser 10, below the top wall 25, and preferably at or near the transition between the lower sidewall 15 and the upper portions is a toothed track 35. The toothed track 35 may include two (2) or more barbs having their pointed ends pointing toward the false bottom 12. In other embodiments the toothed tracks 35 may be disposed on opposing inner surfaces of the condiment container and dispenser 10. The toothed track 35 may or may not be continuous. However, its purpose of puncturing the condiment pack 40 must be achieved.

Still referring to FIGS. 7*a* and 7*b*, the interior of the condiment container and dispenser 10 is partitioned into three (3) relatively distinct volumes. Located just below the false bottom 12 is an inner cavity first region 31*a*. The inner cavity first region 31*a* might be negligible or non-existent when the false bottom 12 is at its bottom most position (FIG. 7*a*). However, as the false bottom 12 is pushed upward that inner cavity first region 31*a* expands. Located above the toothed track 35 is an inner cavity third region 31*c*. Between the false bottom 12 and the toothed tracks 35 is an inner cavity second region 31*b*. As can be understood by contrasting FIGS. 7*a* and 7*b* the dimensions of the inner cavity first region 31*a* and the inner cavity second region 31*b* depend on the position of the false bottom 12. Thus, they are variable.

Still referring to FIGS. 7*a* and 7*b*, the inner cavity second region 31*b* and the inner cavity third region 31*c* are in fluid communication with each other and with the exterior environment through the slot 29. The inner cavity second region 31*b* has an initial volume that retains a full condiment pack 40 and its condiment 45. For example, a full condiment pack 40 might hold between one to two fluid ounces (1-2 fl. oz.) of condiment 45.

In a preferred embodiment the overall height of the condiment container and dispenser 10 along the rear wall 26 might be about three inches (3 in.), about two-and-a-half inches (2½ in.) along the front wall 22, while the diameter of the lower sidewall 15 would beneficially approximately one inch (1 in.). The diameter of the false bottom 12 being slightly less than that. The thickness of the false bottom 12 is beneficially approximately one-quarter-of-an-inch (¼ in.). However, the dimensions of the condiment container and dispenser 10 is ultimately predicated on being suitable for enabling a finger of a user 50 to push upward on the false bottom 12 to expand the inner cavity 31*a* while also allowing the condiment 45 to pass through the slot 29.

The preferred embodiment of the present invention can be utilized by the common user in a simple and effortless manner with little or no training. It is envisioned that the condiment container and dispenser 10 would be constructed in general accordance with FIG. 1 through FIG. 6, and to be used in accord with FIGS. 7*a* and 7*b*. The user would procure the condiment container and dispenser 10, preferably sealed in common packaging material such as cellophane. The condiment container and dispenser 10 should be pre-loaded with a particular condiment 45 in an unbroken condiment pack 40 located in the inner cavity second region 31*b*. The condiment 45 could be identified by indicia on the outside of the condiment container and dispenser 10. However, in some embodiments the false bottom 12 can be made removable, in which case a user could place their desired condiment pack 40 inside the inner cavity second region 31*b*.

A user when then apply force upward on the false bottom 12. That force would move the false bottom 12 into contact with the condiment pack 40. A continued application of force to the false bottom 12 would force the condiment pack 40 into contact with the toothed track 35. Additional pressure would result in the toothed track 35 rupturing the condiment pack 40. This would create a condiment flow 47 into the inner cavity third region 31*c* and through the slot 29 onto an entrée. The serrated edge(s) 30 in the top wall 25 would then be used to spread the condiment 45 as desired over the entrée. In addition, the serrated edge 35 could also be used to cut the entrée.

The foregoing descriptions of specific embodiments of the present invention have been presented for purposes of illustration and description. They are not intended to be exhaustive or to limit the invention to the precise forms disclosed. Obviously, many modifications and variations are possible in light of the above teaching. However, the embodiments were chosen and described in order to best explain the principles of the invention and its practical application, to thereby enable others skilled in the art to best utilize the invention and various embodiments with various modifications as are suited to the particular use contemplated.

The invention claimed is:

1. A condiment dispenser, comprising:

a hollow cylindrical lower sidewall having a bottom with an inwardly projecting shelf, said lower sidewall defining a lower cavity;

a false bottom captured within said lower sidewall by said shelf;

an upper portion extending from said lower sidewall, said upper portion defining an upper cavity, said upper portion having an upper front wall with a first height, a higher upper rear wall, a first side neck wall, a second side neck wall, and a top wall, wherein said top wall extends at an angle upward from said upper front wall to said upper rear wall;

a condiment pack within said lower cavity;

a slot through said top wall to provide fluid communication between the interior of the condiment dispenser and its exterior; and a toothed track inside said condiment dispenser and above said condiment pack;

wherein moving said false bottom toward said top wall causes said condiment pack to rupture;

wherein said lower cavity is dimensioned to receive an inserted finger;

wherein said false bottom is fixed inside said condiment dispenser;

wherein said toothed track includes a downwardly pointed barb; and wherein said condiment pack contains a condiment that is released from said condiment pack when said false bottom pushes said condiment pack into contact with said toothed track.

2. The condiment dispenser to according to claim 1, wherein said false bottom is circular.

3. The condiment dispenser to according to claim 1, wherein said first side neck wall has a curved surface.

4. The condiment dispenser to according to claim 1, further including a serrated edge disposed along said slot.

5. The condiment dispenser to according to claim 1, further including two serrated edges disposed along said slot.

6. A condiment dispenser, comprising:

a hollow cylindrical lower sidewall having a bottom with an inwardly projecting shelf, said lower sidewall defining a lower cavity;

a false bottom captured within said lower sidewall by said shelf;

an upper cavity defined by a front wall that extends upward from said lower sidewall, a higher rear wall that extends upward from said lower sidewall, a curved first side wall that extends upward from said lower sidewall, a curved second wall that extends upward from said lower sidewall, and a top wall across the tops of said front wall, said rear wall, said first side wall, and said second side wall, wherein said top wall extends at an angle upward from said front wall to said rear wall;

a condiment pack within said lower cavity;

a slot through said top wall to provide fluid communication between the interior of the condiment dispenser and its exterior; and a toothed track inside said condiment dispenser and above said condiment pack;

wherein moving said false bottom toward said top wall causes said condiment pack to rupture;

wherein said lower cavity is dimensioned to receive an inserted finger that pushes said false bottom upward;

wherein said toothed track includes a downwardly pointed barb; and wherein said condiment pack contains a condiment that is released from said condiment pack when said false bottom pushes said condiment pack into contact with said toothed track.

7. The condiment dispenser to according to claim 6, wherein said false bottom is circular.

8. The condiment dispenser to according to claim 6, further including a serrated edge disposed along said slot.

9. The condiment dispenser to according to claim 6, further including a first serrated edge disposed along on side of said slot and a second serrated edge disposed along another side of said slot.

* * * * *